US005921401A

United States Patent [19]

Johnston

[11] Patent Number: 5,921,401

[45] Date of Patent: Jul. 13, 1999

[54] MOBILE SCREENING APPARATUS

[76] Inventor: Rafe Johnston, R.F.D. #3, Box 366A, Caribou, Me. 04736

[21] Appl. No.: 08/842,893

[22] Filed: Apr. 16, 1997

[51] Int. Cl.[6] ..... B07B 1/28; B07B 1/34; B07B 1/44; B07B 1/49

[52] U.S. Cl. ..... 209/315; 209/326; 209/311; 209/366.5; 209/421

[58] Field of Search ..... 209/325, 326, 209/311, 315, 332, 366.5, 367

[56] References Cited

U.S. PATENT DOCUMENTS

| | | | |
|---|---|---|---|
| 2,088,313 | 2/1937 | Wettlaufer | 209/326 |
| 3,444,999 | 5/1969 | Hurst | 209/332 |
| 4,256,572 | 3/1981 | Read | 209/325 |
| 4,923,597 | 5/1990 | Anderson et al. | 209/315 |
| 5,219,078 | 6/1993 | Hadden | 209/315 |
| 5,232,099 | 8/1993 | Maynard | 209/366.5 |
| 5,265,730 | 11/1993 | Norrris et al. | 209/326 |
| 5,273,164 | 12/1993 | Lyon | 209/315 |
| 5,328,036 | 7/1994 | Douglas | 209/366.5 |
| 5,614,094 | 3/1997 | Deister et al. | 209/326 |

*Primary Examiner*—William E. Terrell
*Assistant Examiner*—Joe Dillon, Jr.
*Attorney, Agent, or Firm*—Frederick R. Cantor, Esq.

[57] ABSTRACT

A mobile screening apparatus can be vibrated by two similarly-constructed vibration units that are mounted on or near the front and rear walls of the box that contains the vibrating screen assembly. Each vibration unit comprises an hydraulic motor having a stub drive shaft and a circular eccentric cam or weight carried on the shaft. The screen assembly has connections to the circular cams or weights, whereby motor rotation vibrates the screen assembly. The use of stub shafts eliminates whipping shaft motions associated with conventional elongated shafts spanning the screen assembly.

1 Claim, 4 Drawing Sheets

MOBILE SCREENING APPARATUS

FIELD OF THE INVENTION

This invention relates to a mobile screening apparatus, and particularly to a mobile screening apparatus having a novel vibrating mechanism for vibrating the screen assembly.

PRIOR DEVELOPMENTS

My U.S. Pat. No. 5,482,165 shows a mobile screening apparatus wherein a single hydraulic motor imparts vibratory forces to the screen assembly. The vibration mechanism comprises an elongated shaft extending across the space directly below the screen assembly. Eccentric weights are located near opposite ends of the elongated shaft.

The present invention is concerned with a mobile screening apparatus, wherein the elongated shaft is replaced by two stub shafts located along opposite side surfaces of the screen assembly. Each stub shaft is driven by a hydraulic motor located on an exterior side surface of the stationary box that supports the vibrating screen assembly.

The use of an elongated shaft to support eccentrics or offset weights, at opposite ends of the shaft, is widespread in the mobile screening art. U.S. Pat. No. 4,237,000 shows such an elongated shaft. Similarly, U.S. Pat. No. 4,256,572 shows an elongated rotary shaft for imparting vibrational motions to a screen assembly. Such elongated shafts are also shown in U.S. Pat. No. 5,106,490.

SUMMARY OF THE PRESENT INVENTION

The present invention relates to a mobile screening apparatus wherein the aforementioned elongated shaft is replaced by two stub shafts. Each shaft is driven by a separate motor offset from the space below the vibrating screen, whereby the screen area is completely unobstructed.

The elongated rotary shaft used in the prior art arrangements is relatively heavy in order to achieve sufficient shaft stiffness to prevent whipping or bowing of the shaft. I have discovered that the elongated shaft can be replaced with two separate motor-driven stub shafts. The new stub shaft arrangement minimizes the loadings on the shaft bearings, while at the same time reducing the overall weight of the vibrating screen assembly. Less power in required to achieve a satisfactory vibrational motion of the screen assembly. Also, the space below the screen assembly is completely unobstructed, so that the screen assembly has to be cleaned less frequently.

Further advantages of the proposed arrangement will be apparent from the attached drawings and description of illustrative embodiments of the invention.

In summary, and in accordance with the above discussion, the foregoing objectives are achieved in the following embodiments.

1. A mobile screening apparatus comprising a box adapted to rest on the ground surface; said box comprising a front wall, rear wall, and first and second side walls;

a screen assembly disposed within said box, said screen assembly comprising a support frame, and at least one screen supported on said frame;

said frame comprising a front wall extending parallel to the box front wall, a rear wall extending parallel to the box rear wall, a first end wall paralleling the first side wall of the box, and a second end wall paralleling the second end wall of the box;

said screen assembly being sloped downwardly from said first box side wall toward said second box side wall, whereby coarse aggregates are discharged from the screen assembly through said second box side wall; and two similarly-constructed vibration units connected respectively, to said trough front wall and to said trough rear wall on a common axis; each vibration unit comprising a motor having a stub shaft, and means on said stub shaft exerting a vibrational force on said screen assembly.

2. The mobile screening apparatus, as described in paragraph 1, wherein the motor in each vibration unit is mounted on said screen assembly; each vibrational force means comprising an eccentric weight carried by the associated stub shaft.

3. The mobile screening apparatus, as described in paragraph 1, wherein the motor and each vibration unit is mounted on a box wall; each vibrational force means comprising an eccentric cam carried by the associated stub shaft, and a cam follower carried by the screen assembly.

4. The mobile screening apparatus, as described in paragraph 1, wherein said vibration units have a common rotational axis located approximately midway between the box side walls.

5. The mobile screening apparatus, as described in paragraph 1, wherein said screen assembly comprises an upper screen and a lower screen.

6. A mobile screening apparatus comprising a box adapted to rest on the ground surface; said box comprising a front wall, rear wall, and first and second side walls;

a screen assembly disposed within said box, said screen assembly comprising a support frame and at least one screen supported on said frame;

said frame comprising two downwardly sloped frame components located in near proximity to the box front and rear walls; and two similarly constructed vibration units are connected, respectively, to said downwardly sloped frame components on a common axis; each vibration unit comprising a motor mounted on a frame component, two aligned bearings mounted on the frame component, a stub shaft extending from the motor through the aligned bearings, and an eccentric weight carried by the stub shaft in the space between the aligned bearings.

7. The mobile screening apparatus, as described in paragraph 6, wherein said vibration units have a common rotational axis located approximately midway between the box side walls; and said screen assembly comprising an upper screen and a lower screen.

8. The mobile screening apparatus, as described in paragraph 7, and further comprising spring means resiliently supporting said screen assembly; said spring means comprising a pair of coil springs located at each corner of the support frame.

9. A mobile screening apparatus comprising a box adapted to rest on the ground surface; said box comprising a front wall, rear wall, and first and second side walls;

a screen assembly disposed within said box, said screen assembly comprising a support frame, and at least one screen supported on said frame;

said frame comprising a front trough wall extending parallel to the box front wall, a rear trough wall extending parallel to the box rear wall, and an end trough wall paralleling said first side wall of the box; said trough walls slanting downwardly away from the associated box walls, whereby said trough walls guide falling aggregates onto said screen;

said screen assembly being sloped downwardly from said first box side wall toward said second box side wall, whereby coarse aggregates are discharged from the screen assembly through said second box side wall; two similarly-constructed vibration units mounted on said box front wall and said box rear wall on a common axis extending parallel to the box side walls;

each vibration unit comprising a motor supported on an associated wall of the box, a stub drive shaft extending horizontally through the associated wall of the box, and an eccentric on said shaft; each vibration unit further comprising a sleeve affixed to said support frame; and each sleeve encircling an associated eccentric, whereby rotational movements of the drive shafts cause the associated eccentrics to alternately raise and lower said sleeves and the support frame.

10. The mobile screening apparatus, as described in paragraph 9, and further comprising a pedestal bearing for each stub shaft spaced inwardly from the associated box wall.

11. The mobile screening apparatus, as described in paragraph 9, and further comprising a pedestal bearing for each stub shaft, and a platform extending inwardly from the associated box wall for supporting each pedestal bearing; and each said eccentric being located between the associated box wall and the associated pedestal bearing.

12. The mobile screening apparatus, as described in paragraph 11, and further comprising a baffle extending downwardly from said support frame proximate to each pedestal bearing, whereby each bearing is shielded from aggregates falling through the screen assembly.

13. The mobile screening apparatus, as described in paragraph 9, wherein each vibration unit further comprises a pedestal bearing for each stub shaft spaced inwardly from the associated box wall, and a platform extending inwardly from the associated box wall for supporting each pedestal bearing; each said eccentric being located between the associated box wall and the associated pedestal bearing; and said frame having a downwardly extending baffle spaced inwardly from each pedestal bearing, whereby each bearing is shielded from aggregates falling through the screen assembly.

DESCRIPTION OF THE PREFERRED EMBODIMENTS OF THE PRESENT INVENTION

Figure 1:
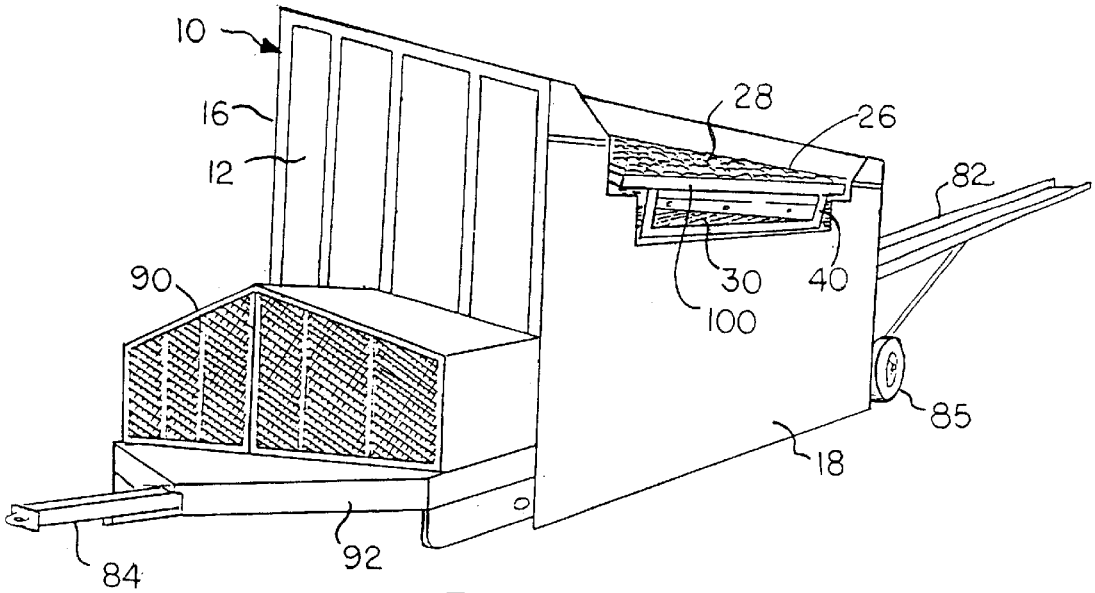
FIG. 1, is a front perspective view, of a mobile screening apparatus embodying the invention.
Figure 2:
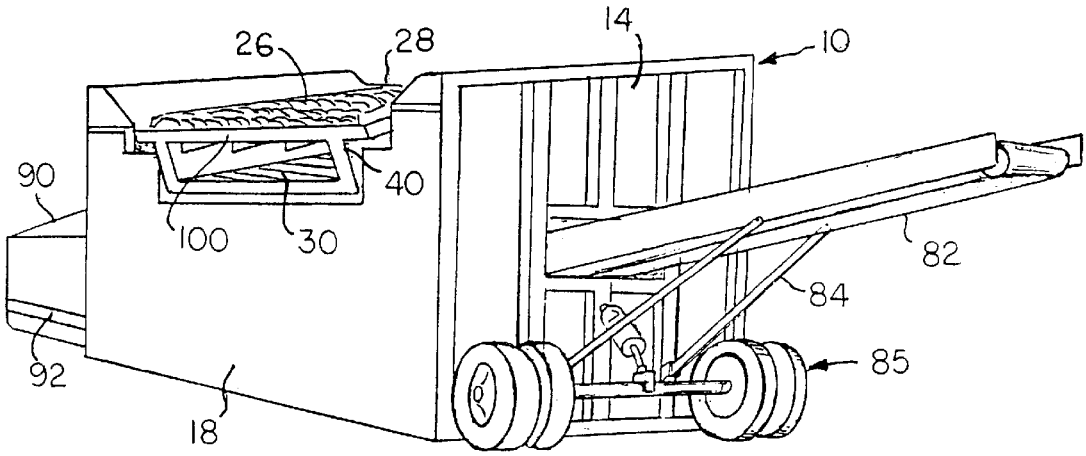
FIG. 2, is a rear perspective view, of the apparatus depicted in FIG. 1.

FIGS. 1 through 5 show a mobile screening apparatus constructed generally along the lines of the apparatus depicted in my issued U.S. Pat. No. 5,482,165. The herein shown apparatus comprises an upright steel box 10 having a reinforced front wall 12, reinforced rear wall 14, first side wall 16, and second side wall 18. The box has a rectangular configuration in the top plan view.

Side wall 16 is provided with an enlarged opening 20 extending to its lower edge 21, whereby a tractor-driven front end loader can be driven into central space 22 to remove particulates, such as small stones, dirt, and/or sand, accumulating on ground surface 24.

As shown in the drawings, a portable conveyor 82 is extended into central space 22 through an opening in rear wall 14 for removing at least some of the aggregates falling from the overhead screen assembly into space 22. The front end of conveyor 82 may be releasably attached to the front wall 12 of box 10, as at 83. The rear end of the conveyor can be supported by two struts 84 that form part of a dolly structure 85 that is used to rollably support box 10 above the ground surface when the apparatus is being towed from one location to another location (via towbar 94).

A screen assembly 26 is disposed within box 10 for receiving a mixture of varying size aggregate from an overhead source, e.g. an overhead bucket or conveyor. The screen assembly comprises a relatively coarse upper screen 28, and a relatively fine lower screen 30. Large size particles retained on screen 28 will be discharged into the external zone alongside wall 18 of the box. A chute structure (not shown) can be arranged to receive the large size particles.

Medium size particles retained on screen 30 can be deposited onto the external ground surface alongside box side wall 18. Alternately a belt conveyor can be arranged alongside wall 18 to receive the medium size particles. The smallest particles fall into central space 22.

Screen assembly 26 comprises a support frame 40 that includes a front frame component 42 extending alongside the box front wall 12, a rear frame component 44 extending alongside the box rear wall 14, and two end frame components 98 extending alongside the two box side walls 16 and 18. The rectangular frame supports the two screens 28 and 30 in vertically spaced relation. The screen assembly is sloped downwardly from box side wall 16 toward box side wall 18.

Figure 3:
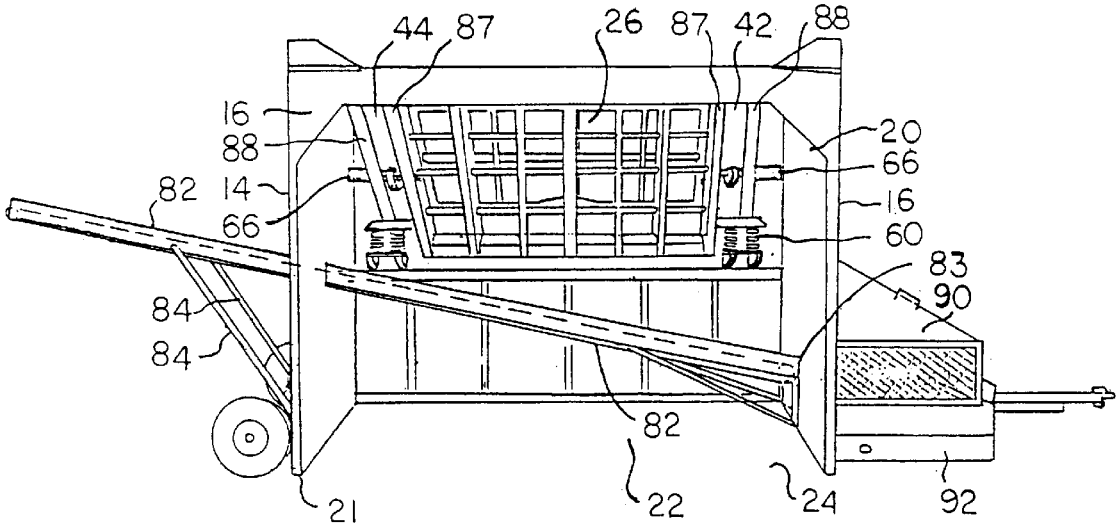
FIG. 3, is a side elevational view, of the FIG. 1 screening apparatus.
Figure 4:
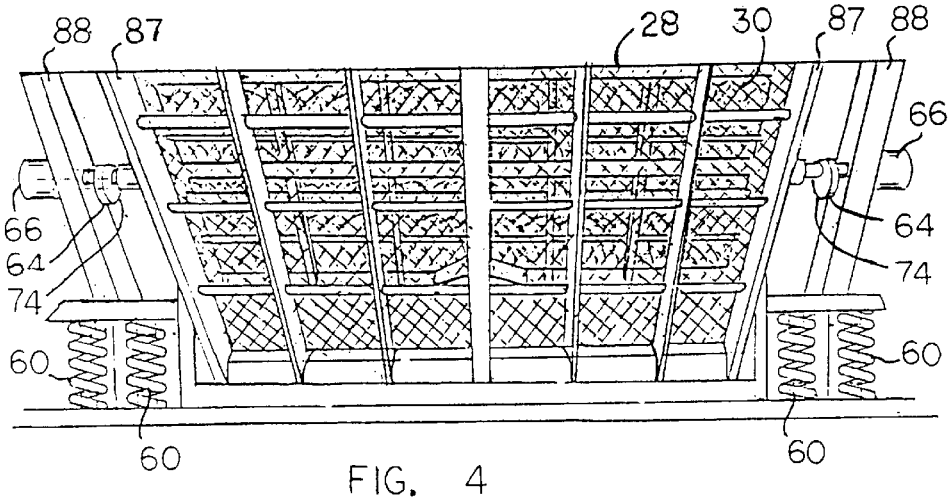
FIG. 4, is a fragmentary enlarged view of a screen assembly depicted in FIG. 3.

FIG. 4, is a fragmentary enlarged view of a screen assembly depicted in FIG. 3.

FIG. 4, is a view looking angularly upwardly at the screen assembly. As shown in FIG. 4, each screen is supported against sagging by a series of bars and rods extending across the support frame 40. Frame 40 is constructed to provide an imperforate peripheral wall structure around the peripheral edges of the two screens 28 and 30, so that particles falling through screen 28 are directed onto screen 30, rather than bypassing around the edges of screen 30.

Figure 5:
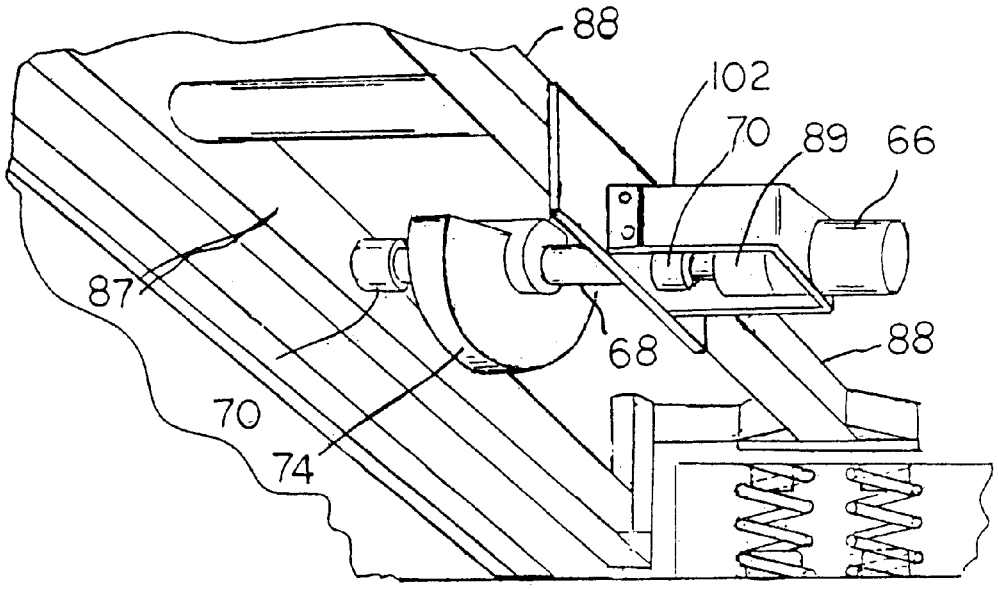
FIG. 5, is a fragmentary perspective view, of a vibration unit employed in the FIG. 1 apparatus.
Figure 8:
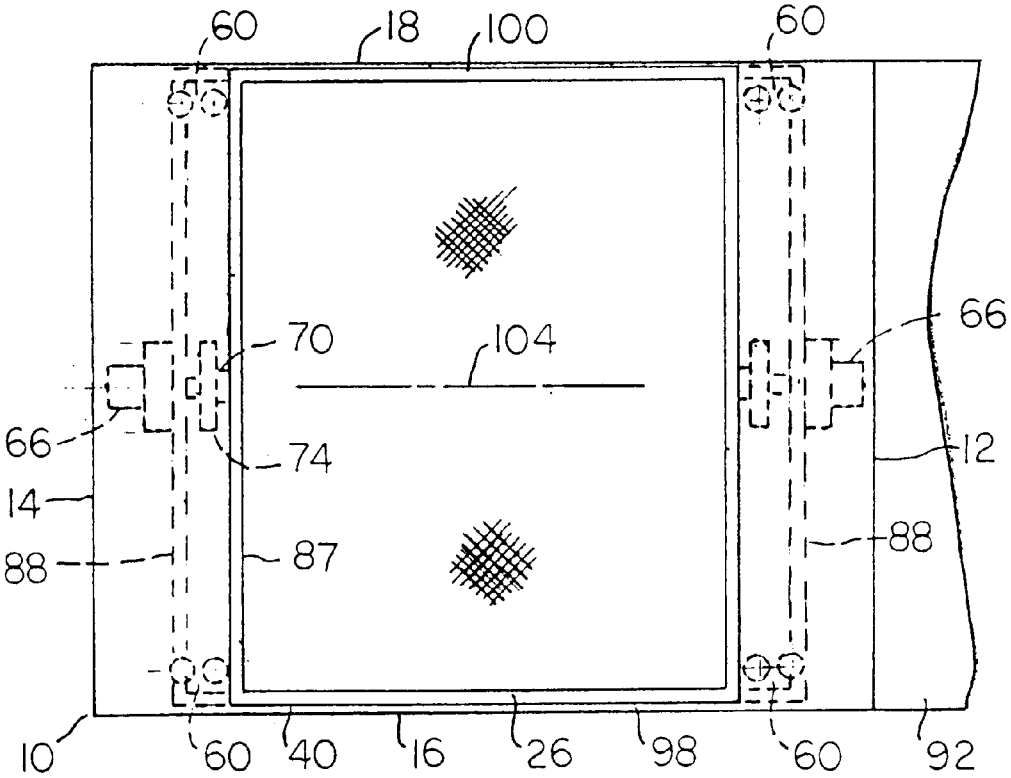
FIG. 8 is a fragmentary plan view of the screening apparatus depicted in FIG. 1.

Each frame component 42 or 44 comprises two parallel beams 87 and 88 spaced several inches apart. Similarly constructed vibration units 64, 64 are supported on these parallel beams at approximately the beam mid-points, i.e. midway between box walls 16 and 18. FIG. 5 shows some features of a representative vibration unit.

FIG. 5, is a fragmentary perspective view, of a vibration unit employed in the FIG. 1 apparatus.

As depicted in FIG. 5, the representative vibration unit comprises a hydraulic motor 66 mounted on a heavy cage structure 102 attached to the outer beam 88. A stub shaft 68 extends between aligned bearings 70, 70 mounted on inner beam 87 and the associated cage structure. A flexible coupling 89 connects the motor drive shaft to stub shaft 68, whereby shaft 68 rotates at the speed dictated by motor 66. The flexible coupling compensates for minor misalignments between the two shafts, and also reduces the shaft loadings on the bearings.

An eccentric weight 74 is carried on stub shaft 68 between the two bearings 70, 70. Rotation of hydraulic motor 66 causes eccentric weight 74 to rotate around the axis 104 of shaft 68, thereby producing a vibratory motion of screen assembly 26. The screen assembly is resiliently supported within box 10 by a spring system that includes a pair of coil springs 60, 60 at each corner of the screen assembly. FIGS. 3 and 4 show springs 60 at the lower two corners of the screen assembly; a similar spring arrangement is used at the upper two corners of the screen assembly.

Hydraulic power is supplied to hydraulic motors 66, 66 by a hydraulic pump located within a protective enclosure 90 supported on a platform 92 at the front end of the mobile screening apparatus. The pump is driven by an engine located within enclosure 90. A towbar 94 extends forwardly from platform 92.

A principal feature of the invention is the use of two aligned vibration units 64 for imparting vibrational forces to screen assembly 26. Each vibration unit has a relatively short stub shaft 68, such that shaft whipping and bowing is not a problem. In the conventional prior art arrangements, an elongated shaft extending across the screen assembly has been used to support two eccentric weights. The elongated shaft was required to be a relatively large diameter structure in order to have the necessary stiffness for resisting the tendency to bow or whip. With the arrangement shown herein, the two stub shafts 68, 68 are relatively light and short, such that bowing does not occur; vibrational forces are directed onto the screen assembly, not into an elongated shaft.

Another potential problem with the conventional elongated shaft is twisting of the shaft. High loadings on the end of the shaft remote from the motor actuator cause the elongated shaft to twist; as the loadings cycle higher or lower the twist force changes, such that fatigue becomes a factor. With the relatively short stub shafts used in the present invention shaft twisting is not a problem.

Figure 6:
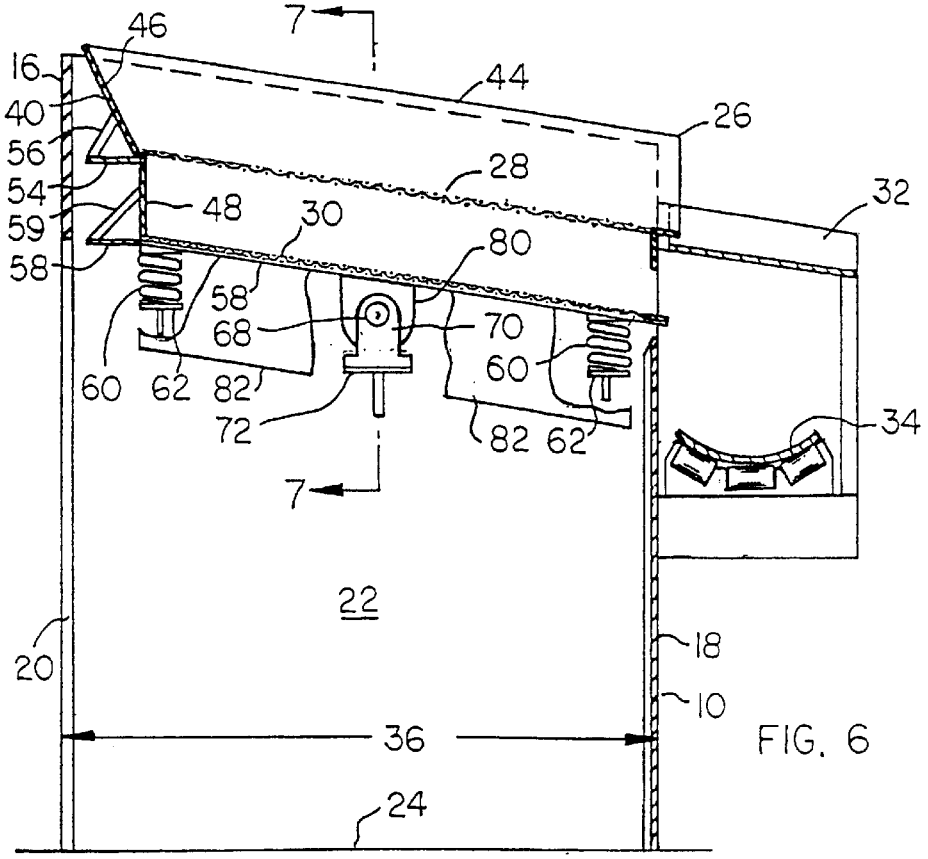
FIG. 6, is a transverse sectional view, taken through another mobile screening apparatus embodying the invention.

FIG. 6, is a transverse sectional view, taken through another mobile screening apparatus embodying the invention.

Figure 7:
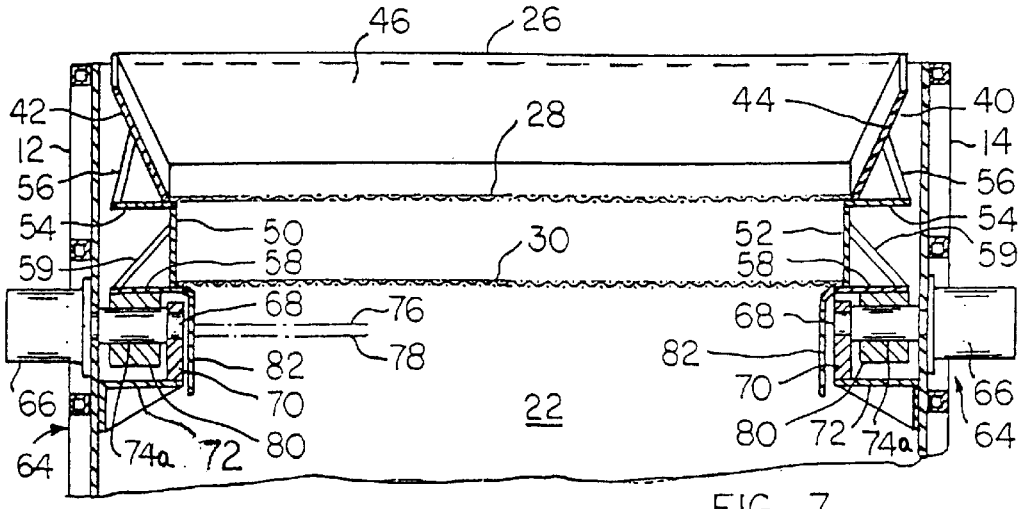
FIG. 7, is a fragmentary sectional view, taken on line 7—7 in FIG. 6.

FIG. 7, is a fragmentary sectional view, taken on line 7—7 in FIG. 6.

FIGS. 6 and 7 show another mobile screening apparatus constructed generally along the lines of the apparatus shown in my issued U.S. Pat. No. 5,482,165. The apparatus comprises an upright steel box 10 having a reinforced front wall 12, reinforced rear wall 14, first side wall 16, and second side wall 18. The box has a rectangular configuration in the top plan view. Side wall 16 is provided with an enlarged opening 20 extending to its lower edge 21, whereby a tractor-driven front end loader can be driven into central space 22 to remove particulates (e.g. small stones, dirt, and/or sand) accumulating on ground surface 24.

A screen assembly 26 is floatably disposed within box 10 for receiving a mixture of varying size aggregates (e.g. small rocks, stones, gravel and dirt) discharged from an overhead bucket or conveyor, not shown. The screen assembly comprises an upper screen 28 and a lower screen 30.

Typically, screen 28 (FIG. 6) will be a coarse screen adapted to pass small and medium size particles downwardly onto screen 30. Large size particles retained on screen 28 will gravitate into a chute 32 attached to side wall 18 of box 10.

Screen 30 has smaller size openings than screen 28, whereby small size particles are allowed to fall through screen 30 into central space 22. Medium size particles retained on screen 30 are deposited onto a belt conveyor 34 attached to side wall 18 of box 10. The belt conveyor and chute 32 will be removed from box side wall 18 when it becomes necessary to move the mobile screening apparatus to a new location. The width dimension 36 of the apparatus is typically about eight or nine feet, such that the apparatus can be towed on the highway, or other surface, when it becomes necessary to relocate the apparatus.

A platform, not shown, is attached to front wall 12 of the box for supporting an engine-driven hydraulic pump. The nose end of the platform has a connecting ball or circular annulus for attaching the platform (and associated box 10) to a hitch on a towing vehicle. A retractable wheel assembly (not shown) is attached to rear wall 14 of box 10 for raising the box from the ground surface when the mobile screening apparatus is in the towing mode. Hydraulic cylinders, powered by the aforementioned hydraulic pump, raise box 10 to put the apparatus in the towing mode. The action of the retractable wheel assembly is more particularly described in my issued U.S. Pat. No. 5,482,165.

Screen assembly 26 comprises a support frame 40 that includes a front trough wall 42 extending parallel to box front wall 12, a rear trough wall 44 extending parallel to the adjacent box rear wall 14, and an end trough wall 46 extending parallel to the associated box side wall 16. The three trough walls 42, 44 and 46 slant downwardly away from associated box walls 12, 14 and 16 so as to guide falling aggregates onto screen 28.

Aggregates discharged from an overhead source are deflected by trough walls 42, 44 and 46 onto screen 28 instead of bypassing the screen or becoming lodged between the screen and side areas of the stationary box.

The support frame 40 comprises three vertical spacer walls 48, 50 and 52 for spacing screen 30 a predetermined distance below screen 28. The frame walls are sloped downwardly in a left-to-right direction so that the particulates move toward side wall 18 of the box while the screen assembly is vibrating. The support frame can also include horizontal walls 54 and struts 56 for reinforcing the trough walls 42, 44 and 46, and laterally extended walls 58 and struts 59 for reinforcing the spacer walls 48, 50 and 52.

The screen assembly 26 is resiliently supported in box 10 by means of four coil springs 60 (two of which are visible in FIG. 6). Each coil spring has its upper end seated against a pad located on the underside of one of the horizontal walls 58; the lower end of each coil spring 60 is seated on a platform 62 extending from box wall 12 or box wall 14. The four coil springs are located approximately at the four corners of screen assembly 26, outside the path of aggregates falling through screen 30.

The screen assembly is vibrated by two similarly-constructed vibration units 64 mounted on box walls 12 and 14 in axial alignment with each other. Each vibration unit comprises an external hydraulic motor 66 supported on the associated box wall 12 or 14, and a stub drive shaft 68 extending from the motor horizontally into central space 22. Each hydraulic motor is supplied with hydraulic fluid from the aforementioned hydraulic pump located in front of wall 12. The outboard end of each stub shaft 68 is supported in a pedestal bearing 70 positioned on a platform 72 suitably mounted on the associated box wall 12 or 14. Each stub shaft 68 can be connected to the motor drive shaft by means of a flexible coupling, for enhanced performance.

FIG. 7, is a fragmentary sectional view, taken on line 7—7 in FIG. 6.

Each stub shaft 68 carries an eccentric circular cam 74*a* that is offset from the shaft axis by a predetermined distance. In FIG. 7 the shaft axis is denoted by numeral 76, and the cam axis is denoted by the numeral 78. The offset between axis 76 and axis 78 produces vibrational motion of screen assembly 26.

A circular sleeve 80 is attached to the underside of the laterally extending walls 58 proximate to box walls 12 and 14; each sleeve 80 encircles an associated circular cam 74*a* to impart vibrational movements to screen assembly 26.

In preferred practice of the invention, the pedestal bearings 70 and coil springs 60 are shielded from falling aggregates by two downwardly extending baffle walls 82 located near the front and rear ends of screen assembly 26. Aggregates falling through screen 30 are prevented from contacting the pedestal bearings or the coil springs.

The space below screen 30 is unobstructed, since stub shafts 68 terminate outside the baffle walls 82. The stub shafts are relatively short and light, such that shaft whipping and bowing is not a problem. Also, the weight reduction achieved by the shorter stub shafts translates into a lower power expenditure for screen vibration purposes, and a reduced loading on the shaft bearings.

It is not necessary that the hydraulic motors operate synchronously. The circular cams 74 do not have to rise and fall together. I have found that the screen assembly can be successfully vibrated without synchronizing the circular cams.

The present invention, described above, relates to a mobile screening apparatus. Features of the present invention are recited in the appended claims. The drawings contained herein necessarily depict structural features and embodiments of the mobile screening apparatus, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed:

1. A mobile screening apparatus comprising a box adapted to rest on the ground surface; said box comprising a front wall, rear wall, and first and second side walls;

a screen assembly disposed within said box; said screen assembly comprising a rectangular support frame, and at least one screen supported on said frame;

said rectangular frame comprising a first frame element (98) extending along said first side wall of the box, a second frame element (100) extending, along said second side wall of the box, a first set of transverse parallel beams (87 and 88) joined to said first and second frame elements in near proximity to the front wall of the box, and a second set of parallel transverse beams (87 and 88) joined to said first and second frame elements in near proximinty to the rear wall of the box; said first and second frame elements being joined to said first and second sets of parallel beams to form four frame corners;

said screen assembly being sloped downwardly from said first box side wall toward said second box side wall;

spring means resiliently supporting said rectangular frame in said box; said spring means comprising a coil spring means (60) located at each corner of the frame;

each set of parallel beams comprising an inner beam (87) and an outer beam (88);

two similarly-constructed vibration units connected, respectively, to each set of parallel beams on a common axis located midway between said first and second frame elements; and each said vibration unit comprising a cage structure attached to the associated outer beam, aligned bearings (70,70) mounted on said inner beam and the associated cage structure, a motor (66) mounted on the cage structure, a stub shaft (68) extending through the aligned bearings, an eccentric weight (74) carried by the stub shaft in the space between the inner and outer beams, and a flexible coupling (89) located within the cage structure between the stub shaft and the motor.

* * * * *